US009142914B2

(12) United States Patent
Jozwik et al.

(10) Patent No.: US 9,142,914 B2
(45) Date of Patent: Sep. 22, 2015

(54) PUSH LOCK ELECTRICAL CONNECTOR

(71) Applicant: Woodhead Industries, Inc., Lisle, IL (US)

(72) Inventors: Keith Jozwik, Lindenhurst, IL (US); Riccardo Comini, Lincolnshire, IL (US); Joseph F. Murphy, Highland Park, IL (US)

(73) Assignee: Woodhead Industries, Inc., Lisle, IL (US)

( * ) Notice: Subject to any disclaimer, the term of this patent is extended or adjusted under 35 U.S.C. 154(b) by 40 days.

(21) Appl. No.: 14/057,614

(22) Filed: Oct. 18, 2013

(65) Prior Publication Data

US 2014/0134871 A1 May 15, 2014

Related U.S. Application Data

(60) Provisional application No. 61/715,952, filed on Oct. 19, 2012.

(51) Int. Cl.
*H01R 4/38* (2006.01)
*H01R 13/622* (2006.01)
*H01R 13/627* (2006.01)

(52) U.S. Cl.
CPC ..... *H01R 13/622* (2013.01); *H01R 13/6273* (2013.01)

(58) Field of Classification Search
CPC ..... H01R 13/622; H01R 13/5219; H01R 13/621; H01R 13/5205; H01R 2103/00; H01R 13/20; H01R 33/22; H01R 16/623
USPC ..... 439/253, 320–322, 256, 257
See application file for complete search history.

(56) References Cited

U.S. PATENT DOCUMENTS

| | | | | |
|---|---|---|---|---|
| 6,280,229 | B1 | 8/2001 | Harting et al. | |
| 6,749,454 | B2 | 6/2004 | Schmidt et al. | |
| 6,884,105 | B2 | 4/2005 | Turck et al. | |
| 6,957,972 | B2 | 10/2005 | Starke et al. | |
| 6,979,225 | B2 * | 12/2005 | Solano | 439/519 |
| 7,238,047 | B2 * | 7/2007 | Saettele et al. | 439/578 |

(Continued)

FOREIGN PATENT DOCUMENTS

| | | | |
|---|---|---|---|
| EP | 1626463 | A2 | 2/2006 |
| EP | 1930989 | A1 | 6/2008 |
| EP | 2390966 | A2 | 11/2011 |

*Primary Examiner* — Abdullah Riyami
*Assistant Examiner* — Thang Nguyen
(74) *Attorney, Agent, or Firm* — Clarence R. Moon

(57) ABSTRACT

An inline multi-pin connector includes cylindrical male and female connector members which are electrically connected together by pushing the two members together end-to-end. Either the male or the female connector member has a metal cylinder disposed about its conductive pins or sockets, which are adapted for mutual engagement, while the other connector member is provided with inner threads. The metal cylinder includes plural resilient, spaced arms, or tabs, disposed about its outer periphery and urged radially outward and into engagement with the other member's threads to connect the two connector members. Coaxial seals are disposed between and in contact with the two members as is a compressible O-ring seal. The outer periphery of the inner member's cylindrical insulator is provided with alternating peaks and valleys, while the other member's metal cylinder is provided with inwardly extending resilient arms which are adapted for positioning within a respective facing valley to prevent vibration-induced disconnection.

33 Claims, 25 Drawing Sheets

(56) References Cited

U.S. PATENT DOCUMENTS

| | | | | |
|---|---|---|---|---|
| 7,503,788 | B2 * | 3/2009 | Holterhoff et al. | 439/256 |
| D626,068 | S | 10/2010 | Giefers et al. | |
| D626,506 | S | 11/2010 | Giefers et al. | |
| 7,850,472 | B2 * | 12/2010 | Friedrich et al. | 439/256 |
| 7,976,341 | B2 | 7/2011 | Osenberg | |
| 8,007,302 | B2 | 8/2011 | Kleinke | |
| 8,235,741 | B2 | 8/2012 | Schulze et al. | |
| 2006/0051999 | A1 | 3/2006 | Allemann et al. | |
| 2007/0293076 | A1 * | 12/2007 | Fehling et al. | 439/320 |
| 2009/0269981 | A1 | 10/2009 | Haruna et al. | |
| 2010/0035457 | A1 * | 2/2010 | Holliday | 439/345 |

* cited by examiner

PUSH LOCK ELECTRICAL CONNECTOR

RELATED APPLICATION

The present application claims 35 USC 119(e) priority from U.S. Provisional application Ser. No. 61/715,952 filed Oct. 19, 2012.

FIELD OF THE INVENTION

This invention relates generally to quick connect/disconnect, multi-pin electrical connectors, and is particularly directed to a push lock electrical connector incorporating metal threads, a high strength, secure seal, and an anti-vibration capability.

BACKGROUND OF THE INVENTION

Inline electrical connectors tend to be of two basic types: the screw-type connector or the bayonet-type connector. The screw-type connector incorporates mating threads on the plug and socket portions of the connector and requires rotation of one or the other to connect the sets of electrical cables together in a sealed manner. Connection and disconnection are labor-intensive and require the application of a predetermined fastening torque to achieve an environmental seal or overcoming of this torque in disconnecting the pair of connector members. The fastening torque may undergo unintended loosening when the connector is subject to vibration forces resulting in loss of the connector seal and interruption of the pin and socket connections. Connection and disconnection of the two threaded connector members is also relatively slow and time consuming. The bayonet-type connection, on the other hand, is easily and quickly formed or disconnected. However, the coupled members in a bayonet connection are more easily separated and the connection broken than in a threaded connector. In addition, the bayonet connection is less adapted for the formation of high strength, tight seals than the threaded connection. Finally, the threaded and bayonet approaches are mutually exclusive, as one cannot be connected to the other which, in some cases, is inefficient and wasteful.

Recent efforts in this area have given rise to the use of segmented thread arrangements on each of the two connecting members which can be joined by pushing one connecting member onto the other in an axial direction, followed by rotation of one or both of the connecting members to place their respective thread arrangements in mutual engagement. Thus, this approach includes pushing the two connector members together as in the bayonet approach, followed by relative rotation between the two connector members to provide their threaded engagement. This combined approach does not afford all of the advantages of both approaches taken individually. For example, rotation of one or both of the connecting members is required for connection, while the integrity and strength of the connection is limited by the partial thread arrays that must be on both connecting members. In addition, the connector's seal is limited because of the hand torque requirement to achieve the environmental seal. One approach in this area utilizes plastic segmented threads that wear after a few couplings and uncouplings of the pair of connector members or lose their ability to "spring back" because the elastic limit of the plastic has been reached. The present invention addresses and overcomes these limitations by providing a push-type connection resulting in full thread engagement between the two connecting members that use a standard thread.

OBJECTS AND SUMMARY OF THE INVENTION

Accordingly, it is an object of the present invention to provide a push-type electrical connector with a threaded connection coupling the two connector members.

It is another object of the present invention to provide a tightly sealed, closed compartment for the plural conductive elements in an inline electrical connector.

Yet another object of the present invention is to provide a vibration-resistant connection between the male and female connecting members of a push-type electrical connector.

A further object is to provide quick and easy push-type engagement between the male and female connecting members of an inline, multi-pin electrical connector, while securely maintaining the two connecting members coupled together by means of a threaded type connecting arrangement.

A still further object of the present invention is to provide a sealed compartment for the contact elements of an electrical connector where the strength of the seal can be easily achieved regardless of the torque used to mate the connector members.

This invention is directed to an inline electrical connector adapted for quick, locked connection by merely pushing the male and female connecting members together in establishing a threaded, sealed connection between the two connecting members. The push lock electrical connector further includes an anti-vibration feature to prevent relative rotational movement between the male and female connecting members to ensure that electrical continuity is maintained. The push lock electrical connector also incorporates metal threads rather than plastic threads to increase reliability and connector operating lifetime. The push lock connector is fully compatible with traditional threaded electrical connectors such as of the M12 threaded type.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
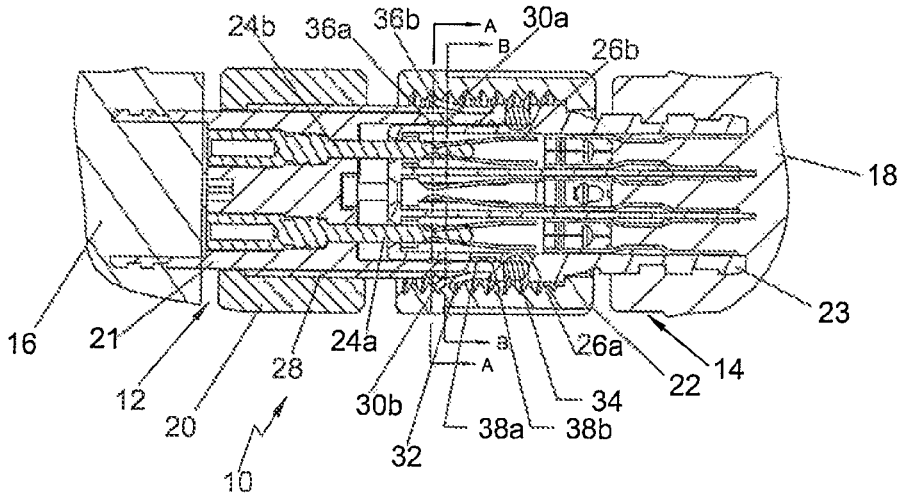
FIG. 1 is a longitudinal sectional view of the push lock electrical connector of the present invention mated, or engaged, with a traditional M12 threaded type electrical connector.

With reference to the above described figures, the push lock electrical connector 10 of the present invention will now be described in detail. Push lock electrical connector 10 includes a male connecting member 12 and a female connecting member 14, with the male connecting member including plural spaced male pins 24*a*-24*d* and the female connecting member 14 including plural spaced sockets 26*a*-26*d*, each adapted for receiving a respective male pin in a tight-fitting manner as shown in FIG. 1. Male connecting member 12 further includes a male overmold 16 coupled on an end thereof to a male insulator insert 21. Plural electrical conductors, or wires, (not shown for simplicity) are disposed in the first male overmold 16, with each of the wires connected to a respective one of the male pins 24*a*-24*d*. Each of the male pins 24*a*-24*d* is inserted through a respective slot within the male insulator 21 and extends into an open recess in the outer end of the male insulator. Coaxially aligned with and disposed between adjacent portions of an outer male coupling sleeve 20 and the inner male insulator insert 21 is a metal cylinder 28.

Female connecting member 14 includes a female overmold 18 attached on an end portion thereof to a female insulator insert 23. Disposed about and engaging an outer surface of the female insulator insert 23 is a female outer coupling sleeve 22 having threads 32 located on an inner surface thereof. Plural spaced female sockets 26*a*-26*d* are attached to an end of the female overmold 18 and are disposed in and extend through respective slots within the female insulator insert 23. Electrical leads, or wires, which are not shown in the figure for simplicity, are each connected to a respective one of the female sockets 26*a*-26*d*. Each of the female sockets 26*a*-26*d* is adapted to receive in tight-fitting engagement a respective one of the male pins 24*a*-24*d* to establish electrical continuity between the plural leads in the male connecting member 12 and the plural leads in the female connecting member 14. An O-ring 34 is disposed between and in contact with female insulator 23 and an end portion of the male insulator 21 to establish a sealed environment for the male pins and female sockets. Male and female insulator inserts 21 and 23 are preferably comprised of plastic, or another material having high dielectric properties.

In one illustrated embodiment, metal cylinder 28 is shown as having four resilient tabs 30*a*-30*d* disposed in a spaced manner about its outer periphery, although the present invention is not limited to this number of resilient tabs on the metal cylinder. Each of the four resilient tabs 30*a*-30*d* is formed by stamping or otherwise deforming the lateral wall of the metal cylinder 28, with each of the resilient tabs extending outwardly in a direction away from the open end portion of male connecting member 12. The orientation and the resilience of each of the four tabs 30*a*-30*d* allows the male connecting member 12 to be inserted, or "pushed", into the female connecting member 14, whereupon the distal ends of each of the four resilient tabs 30*a*-30*d* engage the inner threads 32 of the female outer coupling sleeve 22 as shown in FIG. 1. With the distal ends of each of the four resilient tabs 30*a*-30*d* engaging a portion of the inner threads 32 of the female outer coupling sleeve 22, the male and female connecting members 12, 14 are securely coupled together. The resilience of the tabs 30*a*-30*d* allows their respective distal ends to be displaced radially inwardly upon contacting the crest portions of the threads, with the resilience of the tabs then urging the distal end of each of the tabs radially outward so as to engage an immediately adjacent thread portion during insertion of the male connecting member 12 into the female connecting member 14. Male connecting member 12 is fully inserted in female connecting member 14 when the distal end portion of male insulator 21 engages O-ring 34 to form the above-described seal between the two connecting members for sealing the space in which the male pins 24*a*-24*d* and the female sockets 26*a*-26*d* are disposed. Once inserted into the female connecting member 14 and into engagement with threads 32, it may be necessary to rotate the male connecting member 12 containing the resilient tabs 30*a*-30*d* a partial turn either clockwise or counterclockwise to ensure that the distal ends of the tabs engage inner portions of the threads and not an outer edge of the threads to ensure secure engagement between the resilient tabs and the threads.

Figure 5:
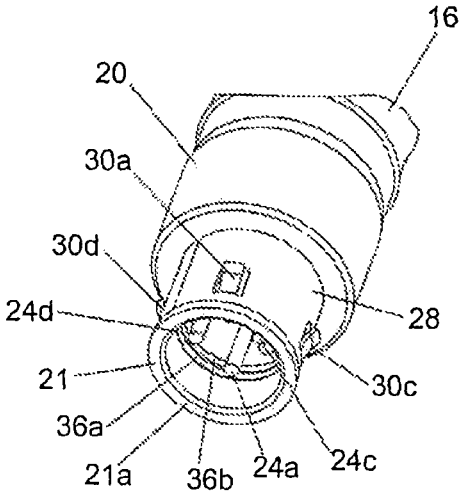
FIGS. 5 and 6 are perspective views of the end portion of the male connecting member of the push lock electrical connector.
Figure 6:
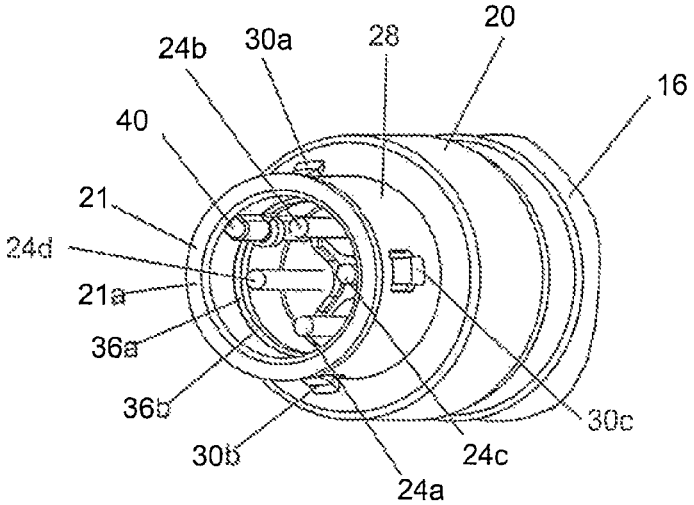
Figure 7:
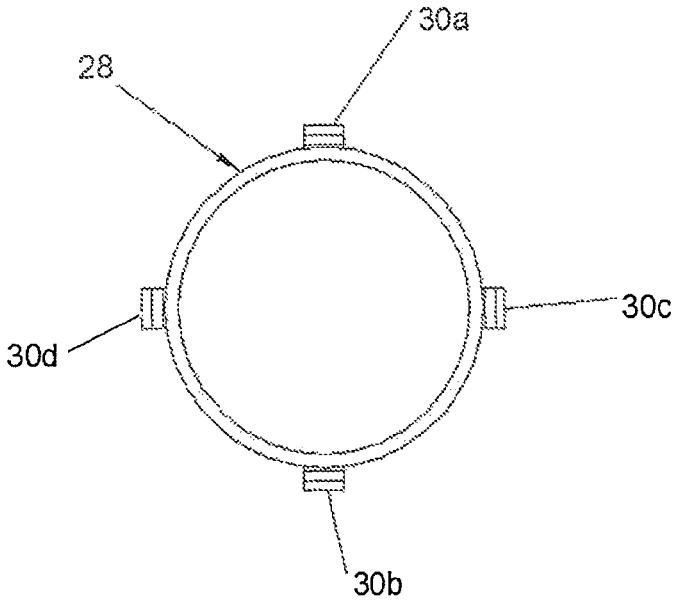
FIGS. 7 and 8 are respectively end-on and side elevation views of the metal cylinder with resilient tabs incorporated in the inventive push lock electrical connector.
Figure 8:
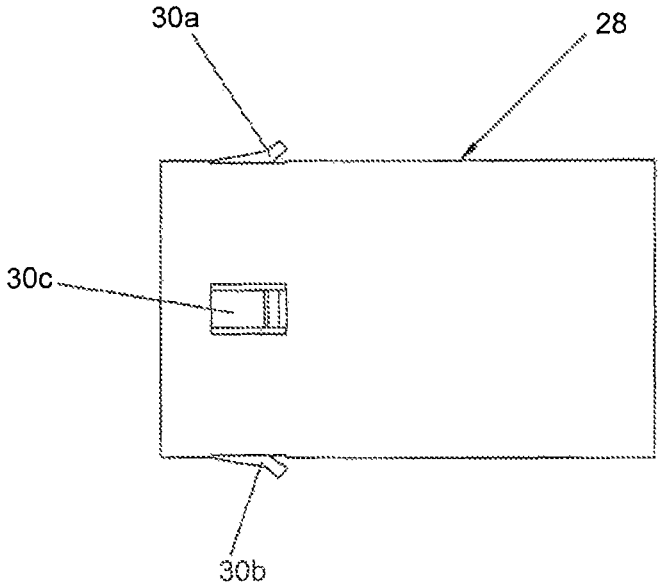

Disposed on the inner surface of male insulator 21 are the aforementioned first and second seals 36*a* and 36*b* as shown in FIGS. 1, 5 and 6. Seals 36*a* and 36*b* also provide a seal for the space within the push lock electrical connector 10 in which the connected male pins 24*a*-24*d* and female sockets 26*a*-26*d* are located. In fact, the first and second seals 36*a*, 36*b* eliminate the need for O-ring 34 in providing a sealed environment for the connected male pins 24*a*-24*d* and female sockets 26*a*-26*d*. While the aforementioned seal is described as formed by first and second seals 36*a*, 36*b* disposed on an inner surface of male insulator 21, the aforementioned seals can also be positioned on the outer surface of the female insulator 23 so as to engage an inner surface of male insulator 21 in forming a seal. Similarly, while two seals 36*a*, 36*b* are disclosed, the invention is not limited to two seals. For example, a higher number of seals could be provided between the male insulator 21 and female insulator 23 to increase the strength of the seal. Conversely, a single seal could be used where the application calls for a seal of reduced strength.

While the illustrated and described embodiment of the invention includes a metal cylinder 28 with resilient tabs 30*a*-30*d* disposed in the male connecting member 12 for engaging threads 32 in the female outer coupling sleeve 22, the metal cylinder could alternatively be positioned within the female connecting member 14 for engaging inner threads provided for on the male insulator 21. The present invention also contemplates the use of a pair of metal cylinders each having a respective set of resilient tabs, with one metal cylinder disposed within the male connecting member 12 and the other metal cylinder disposed within the female connecting member 14. The metal cylinder disposed within the male connecting member 12 would securely engage an inner portion of the female connecting member 14, while the metal cylinder in the female connecting member would securely engage an inner portion of the male connecting member. On the two metal cylinders could be disposed in mutual engagement to provide a secure, sealed coupling between the male and female connecting members 12, 14. In this latter embodiment, neither the male connecting member 12 nor the female connecting member 14 would necessarily include inner threads.

Figure 9:
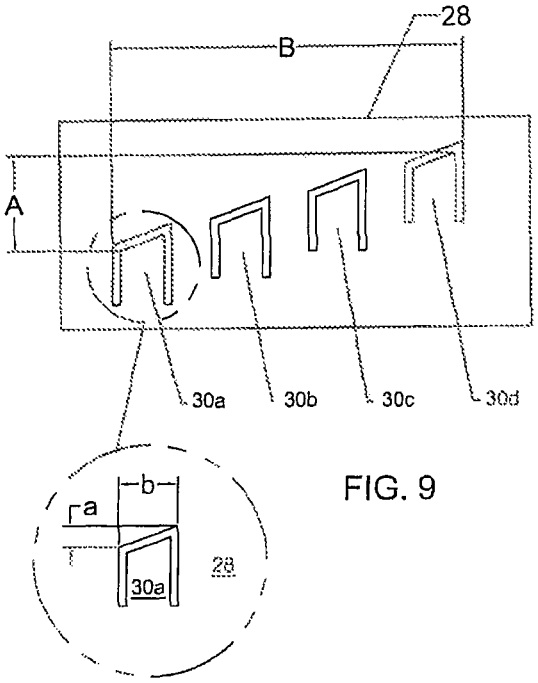
FIG. 9 is a plan view of the metal cylinder with resilient tabs incorporated in the inventive push lock electrical connector prior to being formed into a cylindrical shape.

Referring to FIG. 9, there is shown a plan view of metal cylinder 28 in a flat configuration which is the form of the metal cylinder as originally manufactured. Metal cylinder 28 is then subjected to a rolling process to provide its cylindrical shape. In the embodiment, the metal material is selected having resilient properties such as heat treated beryllium copper but other materials with similar properties can be appreciated. Formed within metal cylinder 28 are the aforementioned four resilient tabs 30*a*-30*d*. Because the resilient tabs 30*a*-30*d* each form a portion of a thread and are adapted for engaging a threaded surface characterized with a given pitch, or slope, the pitch of the array of the four resilient tabs is given by the ration A/B. Similarly, the pitch of each of the individual resilient tabs is given by the ration a/b as shown in the encircled portion of FIG. 9. In the present case, the pitch of the array of the four resilient tabs and the pitch of the individual resilient tabs are equal, or A/B=a/b.

Figure 10:
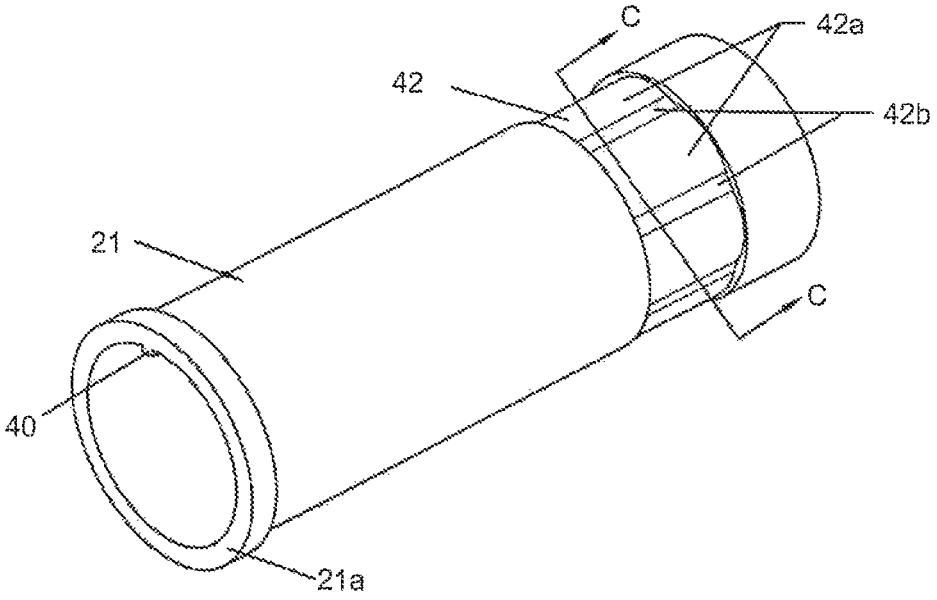
FIGS. 10 and 11 are respectively perspective and transverse sectional views of the male insulator incorporated in the push lock electrical connector of the present invention, where the sectional view of FIG. 11 is taken along site line c-c in FIG. 10.
Figure 11:
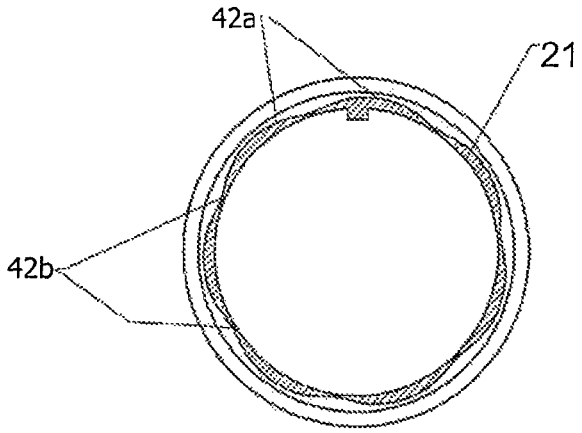

Referring to FIG. 10, there is shown a perspective view of male insulator insert 21. FIG. 11 illustrates a sectional view of the male insulator insert 21 taken along site line C-C in FIG. 10. Along site line C-C, the male insulator insert 21 has an undulating outer surface 42 having a series of alternating upraised portions, or peaks, 42*a* and sunken portions, or valleys, 42*b*.

Figure 12:
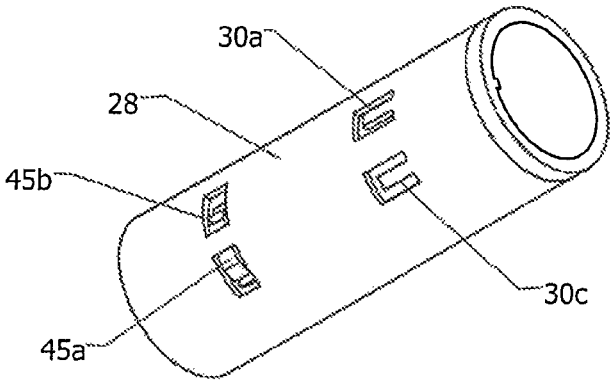
FIG. 12 is a perspective view of metal cylinder with anti-vibration resilient tabs incorporated in the inventive push lock electrical connector.
Figure 13:
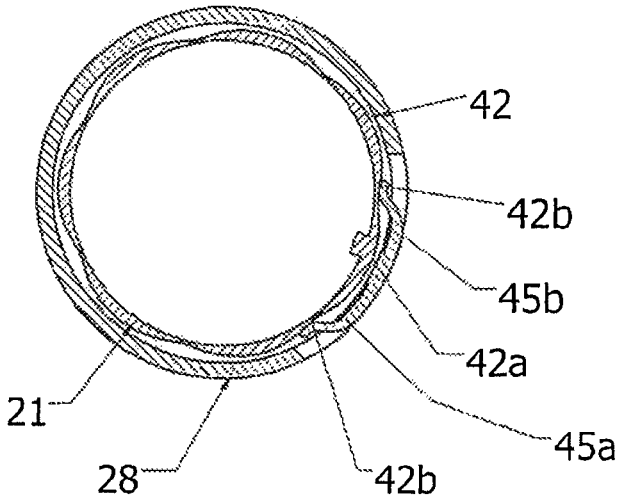
FIG. 13 is a transverse sectional view of the combination of the outer metal cylinder with resilient tabs taken along site line D-D in FIG. 12 and the inner male insulator taken along site line C-C in FIG. 10, which combination provides anti-vibration protection in the push lock electrical connector of the present invention.

FIG. 12 is a perspective view of metal cylinder 28 illustrating a pair of resilient tabs 30*a* and 30*c* disposed in a spaced manner about the outer periphery of the metal cylinder. Also formed in the lateral surface of metal cylinder 28 are first and second inwardly extending arms 45*a* and 45*b*. Arms 45*a* and 45*b* may be formed in metal cylinder 28 by conventional means such as by stamping similar to the manner in which the resilient tabs 30*a*-30*d* are formed in the lateral wall of the metal cylinder. The distal ends of the inwardly extending resilient arms 45*a* and 45*b* are adapted to engage respective sunken portions 42*b* disposed on opposed sides of an adjacent upraised portion 42*a* in the outer surface 42 of the male insulator 21 as shown in FIG. 13. In this manner, the first and second inwardly extending arms 45*a* and 45*b* prevent relative rotation between the outer metal cylinder 28 and the inner male insulator 21 caused by vibration, and thus provide an anti-rotation function in preventing a change in the relative positions of these two connector components caused by environmental vibrations or physical shock experienced by the mated connector components.

Figure 2:
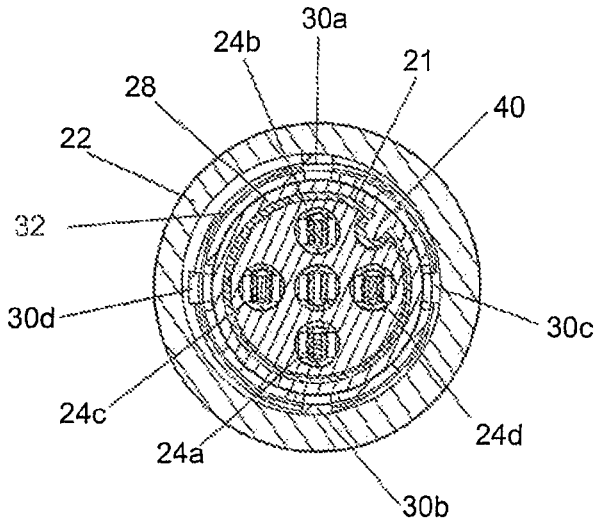
FIG. 2 is a sectional view of the push lock electrical connector taken along site line B-B in FIG. 1.
Figure 3:
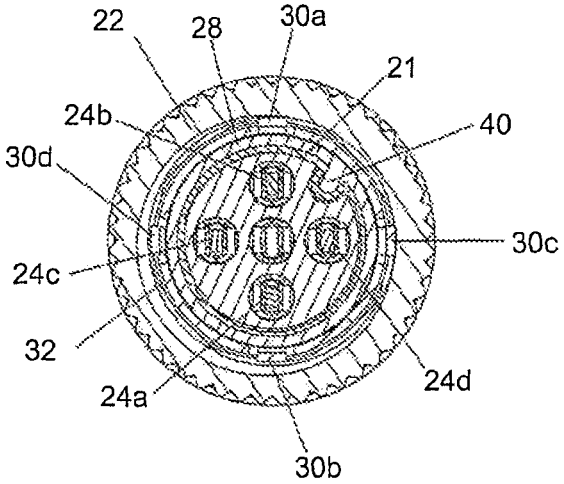
FIG. 3 is a sectional view of the push lock electrical connector taken along site line A-A in FIG. 1.
Figure 4:
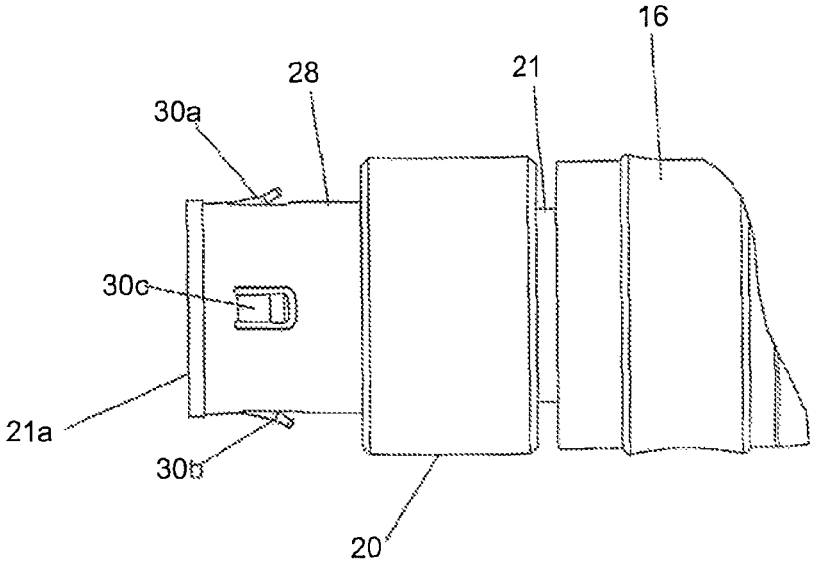
FIG. 4 is a side elevation view of the male connecting member of the push lock electrical connector.

As shown in FIGS. 2, 3 and 10, male insulator 21 includes an inwardly extending rib 40 on its inner periphery adapted for insertion in a generally U-shaped recessed portion 23*a* within female insulator 23. With inner rib 40 disposed within recessed portion 23*a* of female insulator 23, the four male pins 24*a*-24*d* are respectively aligned with the four female sockets 26*a*-26*d* during assembly of the connector to ensure proper electrical connections are made within the mated male and female connecting members 12, 14.

Figure 14:
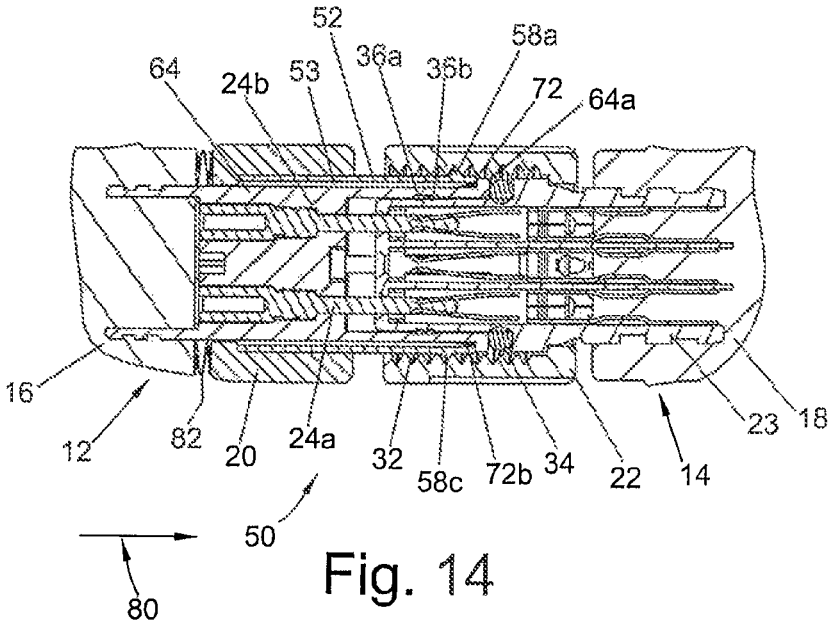
FIG. 14 is a longitudinal sectional view of a second embodiment of the inventive push lock electrical connector mated to a traditional M12 threaded type electrical connector.
Figure 15:
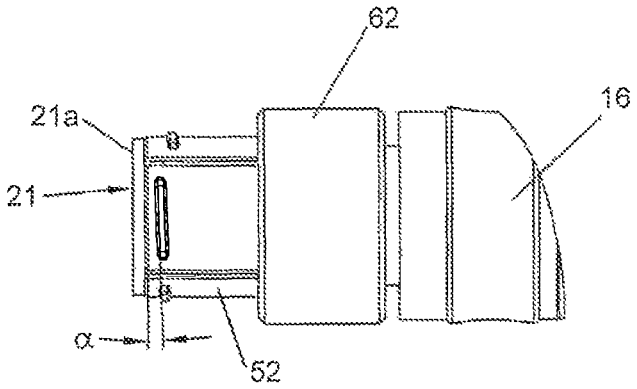
FIG. 15 is a lateral plan view of a portion of the male push-type electrical connector illustrated in FIG. 14.
Figure 16:
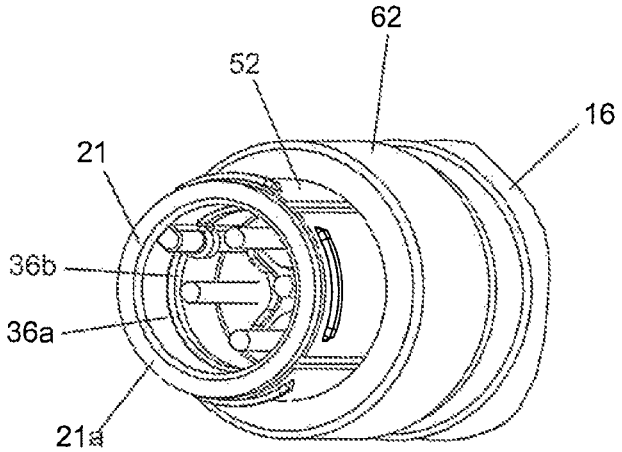
FIG. 16 is a perspective view of the male connector portion of the push lock electrical connector illustrated in FIG. 14.
Figure 17:
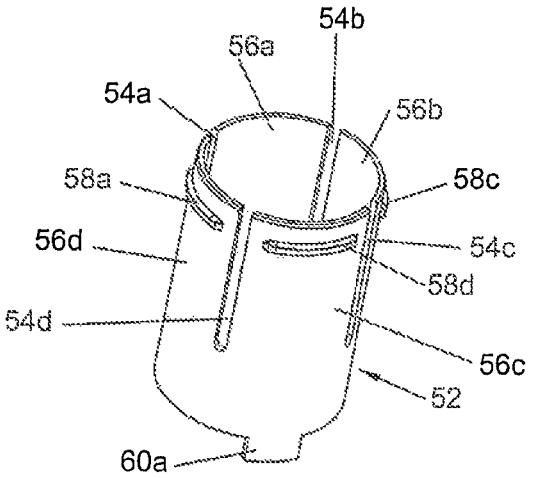
FIG. 17 is a perspective view of the metal cylinder employed in the embodiment of the invention shown in FIG. 14.

Referring to FIG. 14, there is illustrated a longitudinal sectional view of another embodiment of a push-lock electrical connector 50 in accordance with the principles of the present invention. Connector elements common to the first embodiment of the present invention shown in FIG. 1 and the second embodiment shown in FIG. 14 are provided with the same element identifying number. Components of the push lock electrical connector 50 shown in FIG. 14 which are different than corresponding components in the push lock electrical connector 10 shown in FIG. 1 are provided with different element identifying numbers. For example, metal cylinder 52 in the push lock electrical connector 50 embodiment shown in FIG. 14 differs from the corresponding metal cylinder 28 in the embodiment shown in FIG. 1. The male insulator insert 64 in the push lock electrical connector 50 embodiment shown in FIG. 14 also differs from the male insulator insert 21 in the embodiment shown in FIG. 1 as described in the following paragraphs.

Figure 18:
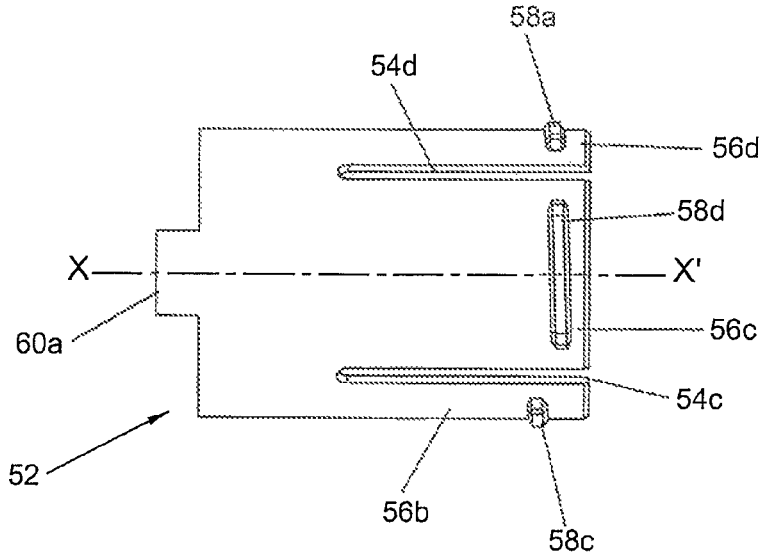
FIG. 18 is a lateral plan view of the metal cylinder illustrated in FIG. 17.
Figure 19:
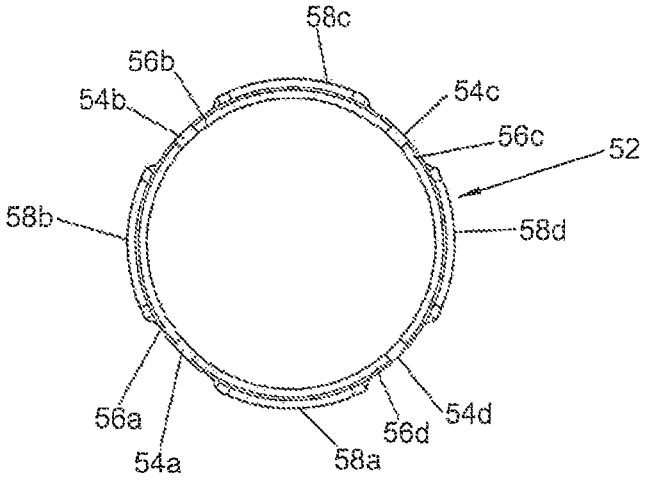
FIG. 19 is an end-on view of the metal cylinder illustrated in FIG. 17.
Figure 20:
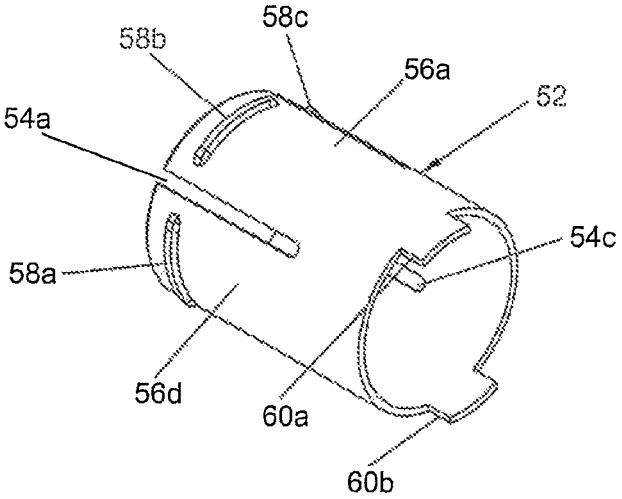
FIG. 20 is another perspective view of the metal cylinder employed in the male electrical connector of FIG. 14.

Referring to FIGS. 15-19, there is shown a second embodiment of the metal cylinder 52 in accordance with the present invention. Metal cylinder 52 includes four generally linearly slots 54*a*-54*d* disposed in a spaced manner about its lateral, cylindrical surface. The space between each pair of adjacent slots defines a respective resilient arm of the metal cylinder 52. Thus, adjacent slots 54*a* and 54*b* define a first resilient arm 56*a*, while adjacent slots 54*b* and 54*c* define a second resilient arm 56*b*. Similarly, adjacent slots 54*c* and 54*d* define a third resilient arm 56*c*, while adjacent slots 54*d* and 54*a* define a fourth resilient arm 56*d*. Disposed adjacent a respective distal end of each of the four resilient arms 56*a*-56*d* is a respective linear projection on its outer surface. Thus, a first linear projection 58*a* is disposed on the outer surface and adjacent to the distal end of the fourth resilient arm 56*d*, while a second linear projection 58*b* is disposed on the outer surface of the first resilient arm 56*a* adjacent its distal end. Similarly, disposed on the outer surface of the second resilient arm 56*b* on its outer surface and adjacent to its distal end is a third linear projection 58*c*, while a fourth linear projection 58*d* is disposed on the outer surface of the third resilient arm 56*c* adjacent its distal end. The four linear projections 58*a*-58*d* are each disposed on a respective outer surface of the first through fourth resilient arms 56*a*-56*d* at an inclined angle relative to a plane orthogonal to the longitudinal axis X-X' as shown in FIG. 18. Inclined angle $\alpha$ equals the inclined angle of the threads 32 disposed on the inner surface of female outer coupling sleeve 22. The four linear projections 58*a*-58*d* are in common alignment about the outer periphery of a metal cylinder 52 and are disposed at the aforementioned inclined angle $\alpha$. Engagement of two opposed linear projections 58*a* and 58*c* with the inner threads 32 of female outer coupling sleeve 22 is shown in the sectional view of FIG. 14. The perspective view of FIG. 16 of male insulator insert 64 shows first and second molded seals 36*a* and 36*b* disposed on the inner surface of the male insulator sleeve so as to engage an outer concentric surface of female insulator insert 23 as in the previously described embodiment.

Figure 21:
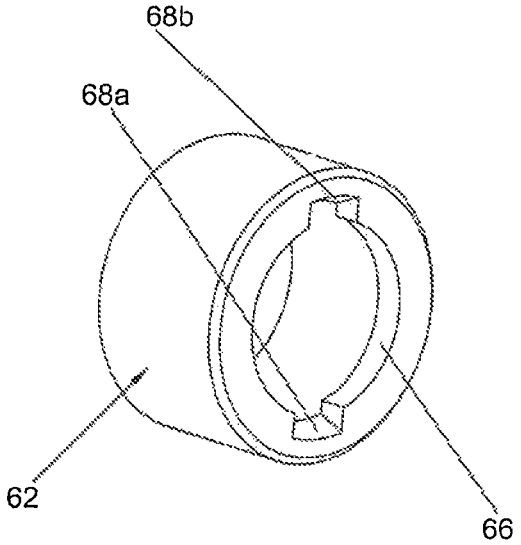
FIG. 21 is a perspective view of the male outer coupling sleeve used with the metal cylinder illustrated in FIGS. 17-20.
Figure 22:
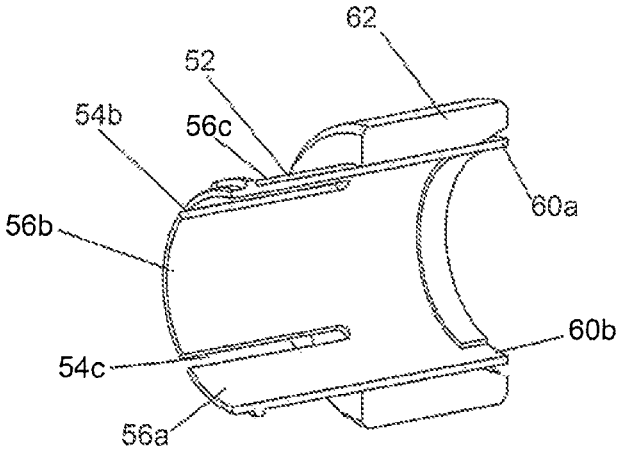
FIG. 22 is a longitudinal sectional view of the combination of the metal cylinder and male outer coupling sleeve incorporated in the male electrical connector of FIG. 14.

As shown in FIGS. 17, 18, 20 and 22, metal cylinder 52 includes a pair of end tabs 60*a* and 60*b* which are disposed on respective opposed end portions of the metal cylinder and extend outwardly along the length of the cylinder. Also shown in FIG. 21 is a perspective view of the male outer coupling sleeve 62 incorporated in the second embodiment of the push lock electrical connector 50 shown in FIG. 14. Male outer coupling sleeve 62 includes a cylindrical aperture, or slot, 66 extending therethrough. Disposed on opposed end portions of cylindrical aperture 66 are first and second opposed slots 68*a* and 68*b*. With metal cylinder 52 inserted in the cylindrical aperture 66 of male outer coupling sleeve 62, each of the opposed slots 68*a*, 68*b* within the male outer coupling sleeve is adapted to receive a respective one of the opposed end tabs 60*a*, 60*b* on the end of the metal cylinder. Each of the end tabs 60*a*, 60*b* is adapted for outward displacement so as to be positioned within and engage a respective one of the opposed slots 68*a* and 68*b* for securely connecting these two components together. In some cases, conventional means such as weldments may also be used to securely connect these two components. Thus, metal cylinder 52 and male outer coupling sleeve 62 are securely coupled together so that manual engagement and rotational or linear displacement of the male outer coupling sleeve results in a corresponding rotational or linear displacement of the inner metal cylinder attached thereto.

Figure 23:
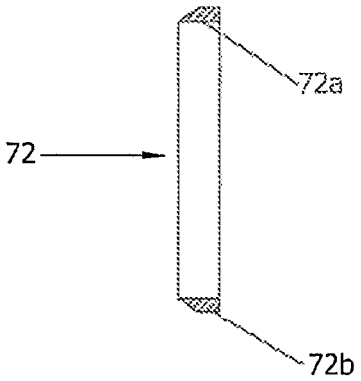
FIGS. 23 and 24 are respectively longitudinal sectional and end-on views of the tapered ring used in the electrical connector of FIG. 14.
Figure 24:
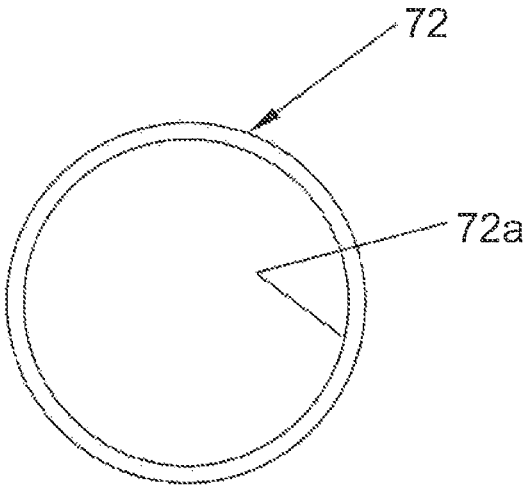

Referring again to FIG. 14, there is shown a tapered ring 72 disposed about and securely attached to the outer surface of male insulator insert 64 adjacent to one end of the male insulator insert. That end of the male insulator insert 64 includes an enlarged circular flange 64*a* disposed about the cylindrical opening at the end of the male insulator insert. A longitudinal sectional view of the tapered ring 72 is shown in FIG. 23, while an axial, or end-on, view of the tapered ring is shown in FIG. 24. Tapered ring 72 includes a circular aperture 72*a* extending through the ring and an outer tapered surface 72*b*, and it is attached to the outer surface of male insulator insert 64 by conventional means such as weldments. Similarly, it is recognized that tapered ring 72 does not need to be a separate part, but could be integrated into male insulator insert 64 by conventional manufacturing methods like molding or die-casting.

As shown in FIG. 14, metal cylinder 52 is disposed in cylindrical spaces formed between an outer surface of male insulator insert 64 and respective inner surfaces of male outer coupling sleeve 20 and female outer sleeve coupling 22. As described above, metal cylinder 52 is fixedly attached to the inner cylindrical surface of male outer coupling sleeve 20. In assembling push lock electrical connector 50, metal cylinder 52 is inserted into the cylindrical spaces disposed about male insulator insert 64 as described above. When male connecting member 12 is fully inserted into female connecting member 14 and male outer coupling sleeve 20 is displaced to the right in the direction of arrow 80 shown in FIG. 14, the distal, or leading, end of metal cylinder 52 engages the tapered surface 72*b* of circular ring 72 and is urged radially outward toward threads 32 disposed on the inner surface of female outer coupling sleeve 22. Disposed on the outer surface of metal cylinder 52 adjacent its distal end are the aforementioned linear projections 58*a*-58*d*, where only two of these projections 58*a* and 58*c* are shown in the sectional view of FIG. 14. With the distal end of metal cylinder 52 deflected radially outward by tapered ring 72, the metal cylinder's outer projections 58*a*-58*d* are displaced radially outward and into engagement with the inner threads 32 of female outer coupling sleeve 22, as shown for the case of linear projections 58*a* and 58*c* in FIG. 14. In this manner, all of the linear projections 58*a*-58*d* disposed on the outer lateral surface of metal cylinder 52 are inserted into the inner threads 32 of female outer coupling sleeve 22. Disposed about male insulator insert 64 and in end-abutting contact with male overmold 16 and male outer coupling sleeve 20 is a short coiled spring 82 which urges male outer coupling sleeve to the right in the direction of arrow 80 so as to maintain the distal end of metal cylinder 52 in contact with tapered ring 72 so that the metal cylinder's distal end remains outwardly biased so as to maintain the metal cylinder's linear projections 58*a*-58*d* in secure engagement with the inner threads 52 of female outer coupling sleeve 22. With metal cylinder's linear projections 58*a*-58*d* engaging the female outer coupling sleeve's inner threads 32, the combination of male coupling sleeve 20 and metal cylinder 52 may be threadably tightened on the electrical connector to compress O-ring seal 34, as desired. Coiled spring 82 facilitates engagement of the metal cylinder's plural outer projections 58*a*-58*d* with the female outer coupling sleeve's inner threads, but is not essentially for proper operation of the inventive push lock electrical connector 10.

Figure 25:
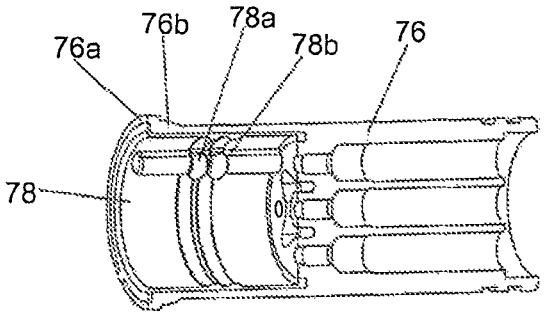
FIG. 25 is a longitudinal sectional view of another embodiment of the male insulator insert used in the electrical connector of FIG. 14, where the male insulator insert is provided with a molded seal on an inner surface thereof.

Referring to FIG. 25, there is shown a longitudinal sectional view of another embodiment of a male insulator insert 76, wherein the open, cylindrical end of the male insulator insert is provided with an enlarged end flange 76*a* and a tapered portion 76*b* which are formed integrally with the male insulator insert. Thus, tapered portion 76*b* of the male insulator insert 76 shown in FIG. 25 replaces the tapered ring 72 described above and illustrated in FIGS. 14, 23 and 24. Disposed on the inner surface of the open end portion of the male insulator insert 76 is a molded flexible seal 78 which adheres to the inner surface of the male insulator insert and includes spaced upraised ring-like portions 78*a* and 78*b* which form seals between the male insulator insert 76 and the female insulator insert which is shown as element 23 in FIG. 14. Molded flexible seal 78 is placed on, adheres to, and conforms with the contours of the inner surface of the open end portion of male insulator insert 76.

Having thus disclosed in detail several embodiments of the invention, persons skilled in the art will be able to modify certain of the structures shown and to substitute equivalent elements for those disclosed while continuing to practice the principles of the invention. For example, while the above discussed embodiments of the present invention are described as having four (4) resilient arms each have a respective outwardly directed thread-engaging member, the present invention is not limited to this specific arrangement and may have more or less of these structural members as the application and composition of these components may dictate. In addition, while cylindrical member is described as disposed radially within the threads of the other connector member, the cylindrical resilient member may also be disposed radial outside of the other connector member and urged radially inward to engage the threads of the other connector member. It is, therefore, intended that all such modifications and substitutions be covered as they are embraced within the spirit and scope of the present invention as described in the claims.

What is claimed is:

1. A push-lock electrical connector including male and female connector members having respective plural conductive pins and sockets adapted for mutual engagement in forming electrical connections, the electrical connector comprising:

a hollow cylindrical member attached to either a first male or female connector member aligned with and disposed about the conductive pins and/or sockets, said cylindrical member having plural spaced radially resilient members formed or extending from a lateral portion of said cylindrical member, a cylindrical insulator insert disposed within said cylindrical member and having disposed on an outer lateral surface thereof alternating upraised and recessed portions, said cylindrical member includes at least one radially inward directed resilient arm adapted for positioning in and engaging a respective recessed portion of said insulator insert; and a cylindrical coupling sleeve attached to a second male or female connector member not attached to said hollow cylindrical member, said coupling sleeve having threads disposed on a lateral portion of said coupling sleeve, with said cylindrical member and said coupling sleeve aligned with one another and moved together so that one connector member receives the other in an overlapping manner along a common axis with each conductive pin engaging a respective socket, wherein said resilient members are urged in a first opposed radial direction and engage the threads of said coupling sleeve for coupling the male and female connector members together in a threaded manner.

2. The electrical connector of claim 1, wherein said hollow cylindrical member is comprised of metal.

3. The electrical connector of claim 2, wherein said metal is heat treated beryllium copper.

4. The electrical connector of claim 2, wherein said resilient members are formed integrally with said cylindrical member.

5. The electrical connector of claim 2, wherein said resilient members are in the form of stamped portions of said cylindrical member.

6. The electrical connector of claim 1 comprising four (4) resilient members equally spaced about the outer periphery of said hollow cylindrical member.

7. The electrical connector of claim 1, wherein said coupling sleeve is disposed about said cylindrical member and said resilient members extend radially outward from said cylindrical member toward and into engagement with an inner threaded portion of said coupling sleeve.

8. The electrical connector of claim 1, wherein said resilient members are disposed on a lateral surface of said cylindrical member in a spiral array to match a pitch of the threads on said coupling sleeve.

9. The electrical connector of claim 1 further comprising an insulator insert disposed within said first male or female connector member and in contact with an inner portion of said cylindrical member.

10. The electrical connector of claim 9, wherein said insulator insert is comprised of plastic, or other material with high dielectric properties.

11. The electrical connector of claim 9 further comprising first and second seal means disposed between and in tight-fitting contact with said insulator insert and the second male or female connector member.

12. The electrical connector of claim 11, wherein said first and second seal means include respective plural generally circular seals disposed in a spaced manner along an axis defined by said first and second male or female connector members.

13. The electrical connector of claim 1, wherein said cylindrical member is disposed co-axially within and along a portion of the length of said coupling sleeve.

14. The electrical connector of claim 9 further comprising third seal means including an O-ring disposed between and in tight-fitting contact with said insulator insert and said second male or female connector member.

15. The electrical connector of claim 1, wherein said cylindrical member includes plural radially inward directed resilient arms each adapted for positioning in and engaging a respective recessed portion of said insulator insert.

16. The electrical connector of claim 1, wherein said resilient arms are formed integral with said cylindrical member.

17. The electrical connector of claim 16, wherein said resilient arms are formed by stamping said cylindrical member.

18. The electrical connector of claim 16, wherein said cylindrical member includes a plural pairs of resilient arms disposed in a spaced manner about its inner periphery, and wherein each pair of said resilient arms is adapted for positioning within and engaging a respective pair of recessed portions of said insulator insert.

19. A push-lock electrical connector including male and female connector members having respective plural conductive pins and sockets adapted for mutual engagement in forming electrical connections, the electrical connector comprising:

a hollow cylindrical member attached to either a first male or female connector member aligned with and disposed about the conductive pins and/or sockets, said cylindrical member having plural spaced radially resilient members formed or extending from a lateral portion of said cylindrical member, said cylindrical member includes plural spaced longitudinal slots in a lateral portion thereof, wherein said longitudinal slots form said plural radially resilient members, said electrical connector further comprising a circular ring for engaging and urging radially outward or inward the distal ends of said resilient members and into engagement with the threads of said coupling; and a cylindrical coupling sleeve attached to a second male or female connector member not attached to said cylindrical member, said coupling sleeve having threads disposed on a lateral portion of said coupling sleeve, with said cylindrical member and said coupling sleeve aligned with one another and moved together so that one connector member receives the other in an overlapping manner along a common axis with each conductive pin engaging a respective socket, wherein said resilient members are urged in a first opposed radial direction and engage the threads of said coupling sleeve for coupling the male and female connector members together in a threaded manner.

20. The electrical connector of claim 19, wherein said cylindrical member includes four (4) longitudinal linear slots forming four (4) radially resilient members in the lateral portion of said cylindrical member.

21. The electrical connector of claim 19, wherein each of said resilient members includes at least one respective projection on a surface thereof adapted to engage the threads of said coupling sleeve for threadably connecting the male and female connector members.

22. The electrical connector of claim 19 further comprising a generally cylindrical first insulator insert disposed in closely spaced relation within said hollow cylindrical member, wherein said cylindrical member is free to move axially along the length of said insulator insert, said circular ring is integrally formed on said insulator insert adapted to engage and urge said resilient arms radially outward or inward and into engagement with the threads of said coupling sleeve.

23. The electrical connector of claim 22, wherein the circular ring of said insulator insert includes an axially expanded or reduced ring portion disposed on an end of said insulator insert and having an outer tapered surface adapted to engage and urge radially outward or inward the distal ends of said resilient arms such that the projections of said resilient arms are urged into engagement with the threads of said coupling sleeve.

24. The electrical connector of claim 23, wherein the outer projections of the cylindrical member's resilient arms are in mutual alignment at an inclined angle relative to a longitudinal axis of said cylindrical member, and wherein said inclined angle matches an inclined angle of the threads.

25. The electrical connector of claim 23 further comprising a seal member disposed between and in intimate contact with said first insulator insert and a second insulator insert in a second male or female connector member coupled to said first male or female connector member.

26. The electrical connector of claim 25, wherein said seal member is in contact with an end of said first insulator insert and is compressed by said first insulator insert and said second insulator when said first male or female connector member is rotationally displaced about said threads and tightened on said second male or female connector member.

27. The electrical connector of claim 26, wherein said seal member is in the form of a circular O-ring and is further in contact with a portion of said threads.

28. The electrical connector of claim 27 further comprising a first cylindrical coupling sleeve disposed on said first or male connector member and adapted for manual engagement and displacement along said first male or female connector member.

29. The electrical connector of claim 28, wherein said first coupling sleeve is fixedly attached to said cylindrical member to facilitate manual rotational displacement of said cylindrical member on the threads of said second coupling sleeve for coupling or de-coupling the male and female connector members.

30. The electrical connector of claim 29, wherein said cylindrical member includes plural spaced end tabs and said first coupling sleeve includes plural spaced slots, and wherein each slot is adapted to receive and securely engage a respective tab for fixedly attaching said cylindrical member to said first coupling sleeve.

31. The electrical connector of claim 23, wherein said ring is formed integrally with said insulator insert.

32. The electrical connector of claim 19 wherein said resilient members are initially deflected radially in a second direction by said cylindrical coupling sleeve upon insertion of said cylindrical member into said coupling sleeve, wherein said second radial direction is opposed to said first radial direction.

33. The electrical connector of claim 19 wherein said first radial direction is outward and said second radial direction in inward.

* * * * *